US010477924B2

(12) United States Patent
Midorikawa

(10) Patent No.: US 10,477,924 B2
(45) Date of Patent: Nov. 19, 2019

(54) WINDING DEVICE

(71) Applicant: JAPANA CO., LTD., Nagoya, Aichi (JP)

(72) Inventor: Shinobu Midorikawa, Nagoya (JP)

(73) Assignee: JAPANA CO., LTD., Nagoya (JP)

( * ) Notice: Subject to any disclaimer, the term of this patent is extended or adjusted under 35 U.S.C. 154(b) by 169 days.

(21) Appl. No.: 15/537,991

(22) PCT Filed: Jun. 12, 2015

(86) PCT No.: PCT/JP2015/067010
§ 371 (c)(1),
(2) Date: Jun. 20, 2017

(87) PCT Pub. No.: WO2016/103764
PCT Pub. Date: Jun. 30, 2016

(65) Prior Publication Data

US 2018/0035761 A1 Feb. 8, 2018

(30) Foreign Application Priority Data

Dec. 22, 2014 (JP) ..... 2014-259024

(51) Int. Cl.
*A43C 11/20* (2006.01)
*A43B 23/02* (2006.01)
(Continued)

(52) U.S. Cl.
CPC ..... *A43C 11/20* (2013.01); *A43B 23/02* (2013.01); *A43C 11/165* (2013.01); *A43B 5/0401* (2013.01)

(58) Field of Classification Search
CPC ..... A43B 23/02; A43B 5/0401; A43C 11/20; A43C 11/165; A43C 7/00; Y10T 24/2183
See application file for complete search history.

(56) References Cited

U.S. PATENT DOCUMENTS 4,787,124 A 11/1988 Pozzobon
5,325,613 A * 7/1994 Sussmann ..... A43C 11/00 24/712.2
(Continued)

FOREIGN PATENT DOCUMENTS

DE 202011101828 U1 * 6/2011
JP 63-89103 4/1988
(Continued)

OTHER PUBLICATIONS

PCT/JP2015/067010, Aug. 25, 2015, International Search Report.

*Primary Examiner* — Victor D Batson
*Assistant Examiner* — Matthew J Sullivan
(74) *Attorney, Agent, or Firm* — Workman Nydegger

(57) ABSTRACT

It is an object of the present invention to provide a winding device that can correctly and separately rotate and drive two winding units by changing a rotation direction of a handle. The present invention is a winding device (10) including a first rotation shaft (11) that rotates and drives a first string winding unit (D1), a second rotation shaft (12) arranged coaxially with the first rotation shaft (11) to rotate and drive a second string winding unit (D2), a first gear (G1) coupled to the first rotation shaft (11), a second gear (G2) coupled to the second rotation shaft (12), a sliding gear member (40) arranged between the first and second gears (G1, G2) and including a third gear (G3) and a fourth gear (G4) respectively engaged with the first gear (G1) and the second gear (G2), a handle (50) including a gear accommodation portion (51) that accommodates the first to fourth gears (G1 to G4), an inclined groove (55) formed in an inner surface of the gear accommodation portion (51), and an engagement projection (45) that is formed on an outer surface of the sliding gear member (40), engages the inclined groove (55), and is slidable in the inclined groove (55).

3 Claims, 7 Drawing Sheets

(51) Int. Cl.
*A43C 11/16* (2006.01)
*A43B 5/04* (2006.01)

(56) References Cited

U.S. PATENT DOCUMENTS

| | | | | |
|---|---|---|---|---|
| 7,096,559 | B2 * | 8/2006 | Johnson | A43B 11/00 29/433 |
| 7,516,914 | B2 * | 4/2009 | Kovacevich | A42B 3/08 242/388.8 |
| 7,584,528 | B2 * | 9/2009 | Hu | A43C 11/16 24/68 SK |
| 8,231,074 | B2 * | 7/2012 | Hu | A43C 11/165 24/68 SK |
| 9,918,516 | B1 * | 3/2018 | Hall | A43C 1/00 |
| 2005/0247813 | A1 | 11/2005 | Kovacevich et al. | |
| 2006/0015988 | A1 * | 1/2006 | Philpott | A42B 3/08 2/410 |
| 2006/0021204 | A1 | 2/2006 | Young | |
| 2011/0167543 | A1 * | 7/2011 | Kovacevich | A42B 3/145 2/417 |

FOREIGN PATENT DOCUMENTS

| | | |
|---|---|---|
| JP | 2007-330808 | 12/2007 |
| JP | 4171774 | 8/2008 |
| JP | 4514383 | 5/2010 |
| JP | 2010-148927 | 7/2010 |
| JP | 4538836 | 7/2010 |
| JP | 2012-120678 | 6/2012 |
| JP | 2012-120679 | 6/2012 |

* cited by examiner

WINDING DEVICE

FIELD OF THE INVENTION

The present invention relates to a winding device, more specifically, to a winding device suitable for tightening shoestrings of boots or the like used for skiing, snowboarding, skating, mountain climbing, or motorcycle riding or for tightening strings of bags.

BACKGROUND OF THE INVENTION

Winding devices are proposed in the prior art to wind and tighten shoestrings of boots used for skiing, snowboarding, skating, and the like by rotating a handle (circular knob) (patent documents 1 to 5).

There is a need for snowboard boots or the like that allow the shoestring tightening degree to be separately adjusted at the instep of the shoe body and the portion above the ankle. In order to tighten each portion of such a dual-adjustment shoestring, two winding devices need to be coupled to the shoe in the winding device of the above patent documents.

Thus, a tightening device that allows the dual-adjustment shoestring to be separately tightened with a single tightening device has been proposed (patent documents 6 to 9).

However, in the winding device of patent document 6, rotation shafts of two winding units are not coaxially arranged. This enlarges the entire device.

In the winding device of patent document 7, a pulley is pressed by a handle to control the winding of the shoestrings. Thus, when winding different portions of a shoestring, it is difficult to recognize the actuation state of each winding device.

In the tightening devices of patent documents 8 and 9, gears are formed above and below a handle, and the upper and lower gears are driven. In this case, the handle needs to be rotated while making sure that the handle is pressed against the gear.

Further, in the winding devices of patent documents 8 and 9, when such a dial is weakly pressed, the dial may rotate freely. In such a case, the shoestring tightening degree cannot be smoothly adjusted.

PRIOR ART DOCUMENT

Patent Documents

Patent Document 1: Japanese Patent No. 4171774

Patent Document 2: Japanese Patent No. 4514383

Patent Document 3: Japanese Laid-Open Patent Publication No. 2007-330808

Patent Document 4: Japanese Laid-Open Patent Publication No. 2010-148927

Patent Document 5: Japanese Patent No. 4538836

Patent Document 6: Japanese Laid-Open Patent Publication No. S63-89103

Patent Document 7: U.S. Pat. No. 5,325,613

Patent Document 8: Japanese Laid-Open Patent Publication No. 2012-120678

Patent Document 9: Japanese Laid-Open Patent Publication No. 2012-120679

SUMMARY OF THE INVENTION

Problems that are to be Solved by the Invention

The problems that are to be solved by the present invention are that the winding device is not suitable for reduction in size, the actuation state of the winding unit cannot be easily recognized, and a string winding unit cannot be correctly rotated unless the dial is correctly operated and rotated. It is an object of the present invention to provide a winding device that is compact, reduces the number of components, has superior strength and durability, and allows for a simple and easy operation of changing a rotation direction of a handle to automatically switch two string winding units and separately rotate the two shoe winding units.

Means for Solving the Problem

The most important feature of the present invention is a winding device including a first rotation shaft that rotates and drives a first string winding unit, a second rotation shaft arranged coaxially with the first rotation shaft to rotate and drive a second string winding unit, a first gear coupled to the first rotation shaft, a second gear coupled to the second rotation shaft and located at a position opposing the first gear and spaced apart from the first gear, a sliding gear member arranged between the first and second gears and including a third gear and a fourth gear respectively engaged with the first gear and the second gear, a handle including a gear accommodation portion that accommodates the first gear, the second gear, and the sliding gear member, an inclined groove formed in an inner surface of the gear accommodation portion, and an engagement projection that is formed on an outer surface of the sliding gear member, engages the inclined groove, and is slidable in the inclined groove. A change in a rotation direction of the handle moves the sliding gear member in an axial direction of the first and second rotation shafts and switches the gear engaged with and rotated and driven by the gear of the sliding gear member between the first gear and the second gear.

Further, the present invention is a winding device including a first rotation shaft that rotates and drives a first string winding unit, a second rotation shaft arranged coaxially with the first rotation shaft to rotate and drive a second string winding unit, a first gear coupled to the first rotation shaft, a second gear coupled to the second rotation shaft and located at a position opposing the first gear and spaced apart from the first gear, a sliding gear member arranged between the first and second gears and including a third gear and a fourth gear respectively engaged with the first gear and the second gear, a handle including a gear accommodation portion that accommodates the first gear, the second gear, and the sliding gear member, an inclined groove formed on an outer surface of the sliding gear member, and an engagement projection that is formed on an inner surface of the gear accommodation portion, engages the inclined groove, and is slidable in the inclined groove. A change in a rotation direction of the handle moves the sliding gear member in an axial direction of the first and second rotation shafts and switches the gear engaged with and rotated and driven by the gear of the sliding gear member between the first gear and the second gear.

In the winding device of the present invention, the engagement projection may be one of a plurality of engagement projections formed in equal intervals.

In the winding device of the present invention, the engagement projection may be formed as a quadrangle post including two parallel sides that contact side surfaces of the inclined groove.

In the winding device of the present invention, the first to fourth gears may each include saw-like teeth arranged along a circumference, and the first gear and the second gear may be directed in opposite directions and the third gear and the fourth gear may be directed in opposite directions so that the first rotation shaft and the second rotation shaft are rotated and driven in different directions.

In the winding device of the present invention, the gear accommodation portion may be tubular and have a closed end. The inclined groove may extend in an inner surface of the gear accommodation portion from an opening of the gear accommodation portion toward the closed end of the gear accommodation portion. The winding device may include a lock member that restricts a slidable range of the engagement projection, which is arranged in the inclined groove, from the opening of the gear accommodation portion and restricts separation of the engagement projection from the inclined groove.

The winding device of the present invention can be used in a preferred manner to realize a shoe that allows two shoestrings located at different positions to be separately tightened by the winding device.

Effects of the Invention

In the winding device of the present invention, a change in the rotation direction of the handle changes a direction in which the engagement projection formed on the outer surface of the sliding gear member slides in the inclined groove, which is formed in the inner surface of the gear accommodation portion, in the axial direction of the first and second rotation shafts. This automatically switches the gear engaged with the gear of the sliding gear member between the first gear and the second gear. Thus, a simple and easy operation of changing the rotation direction of the handle selectively rotates and drives the first rotation shaft or the second rotation shaft. This realizes excellent operability.

In the winding device of the present invention, when the engagement projections formed in the inner surface of the gear accommodation portion slide in the inclined groove, which is formed on the outer surface of the sliding gear member, in the axial direction of the first and second rotation shafts, the gear engaged with the gear of the sliding gear member can be automatically switched between the first gear and the second gear. Thus, a simple and easy operation of changing the rotation direction of the handle selectively rotates and drives the first rotation shaft or the second rotation shaft. This realizes excellent operability.

In the winding device of the present invention, formation of a plurality of engagement projections in equal intervals slides the sliding gear member smoothly in a balanced manner, distributes stress applied to the engagement projection and the inclined groove, produces a large drive force, and improves the strength and durability of each portion.

In the winding device of the present invention, when the engagement projection is formed as a quadrangle post including two parallel sides that contact side surfaces of the inclined groove, the contact area of the engagement projection and the side surface of the inclined groove and the cross-sectional area of the engagement projection increase. Further, the strength and durability of the engagement projection is improved, and reliability of the entire device increases.

In the winding device of the present invention, when the first to fourth gears each include saw-like teeth arranged along a circumference, the first gear and the second gear are directed in opposite directions and the third gear and the fourth gear are directed in opposite directions so that the first rotation shaft and the second rotation shaft are rotated and driven in different directions, and the first to fourth gears are strongly engaged in a limited and narrow space around the rotation shafts. This allows a large rotation force to be produced by the handle to be transmitted smoothly and effectively.

Further, when the gears are rotated and driven, no portion slides in contact with each other once the gears are engaged. This increases the durability of the gear.

In the winding device of the present invention, operation stability and usability of the device are improved when the gear accommodation portion is tubular and has a closed end, the inclined groove extends in an inner surface of the gear accommodation portion from an opening of the gear accommodation portion toward the closed end of the gear accommodation portion, and the winding device includes a lock member that restricts a slidable range of the engagement projection, which is arranged in the inclined groove, from the opening of the gear accommodation portion and restricts separation of the engagement projection from the inclined groove.

In the shoe including the winding device of the present invention, a simple and easy operation of changing the rotation direction of the handle allows the drive force produced by the handle to be automatically distributed to the first rotation shaft or the second rotation shaft. Thus, the shoestring winding operation with the handle is no longer complicated.

DETAILED DESCRIPTION OF THE INVENTION

The present invention is preferably a winding device including a first rotation shaft that rotates and drives a first string winding unit, a second rotation shaft arranged coaxially with the first rotation shaft to rotate and drive a second string winding unit, a first gear coupled to the first rotation shaft, a second gear coupled to the second rotation shaft and located at a position opposing the first gear and spaced apart from the first gear, a sliding gear member arranged between the first and second gears and including a third gear and a fourth gear respectively engaged with the first gear and the second gear, a handle including a gear accommodation portion that accommodates the first gear, the second gear, and the sliding gear member, an inclined groove formed in an inner surface of the gear accommodation portion, and an engagement projection that is formed on an outer surface of the sliding gear member, engages the inclined groove, and is slidable in the inclined groove. A change in a rotation direction of the handle moves the sliding gear member in an axial direction of the first and second rotation shafts and switches the gear engaged with and rotated and driven by the gear of the sliding gear member between the first gear and the second gear. The present invention can be realized by embodiments described below.

Further, the present invention is a shoe including the above winding device and can be used in a preferred manner to realize a shoe that allows different shoestring winding operations to be easily performed with a simple and easy operation of changing the rotation direction of the handle.

A winding device according to one embodiment of the present invention will now be described.

Figure 8:
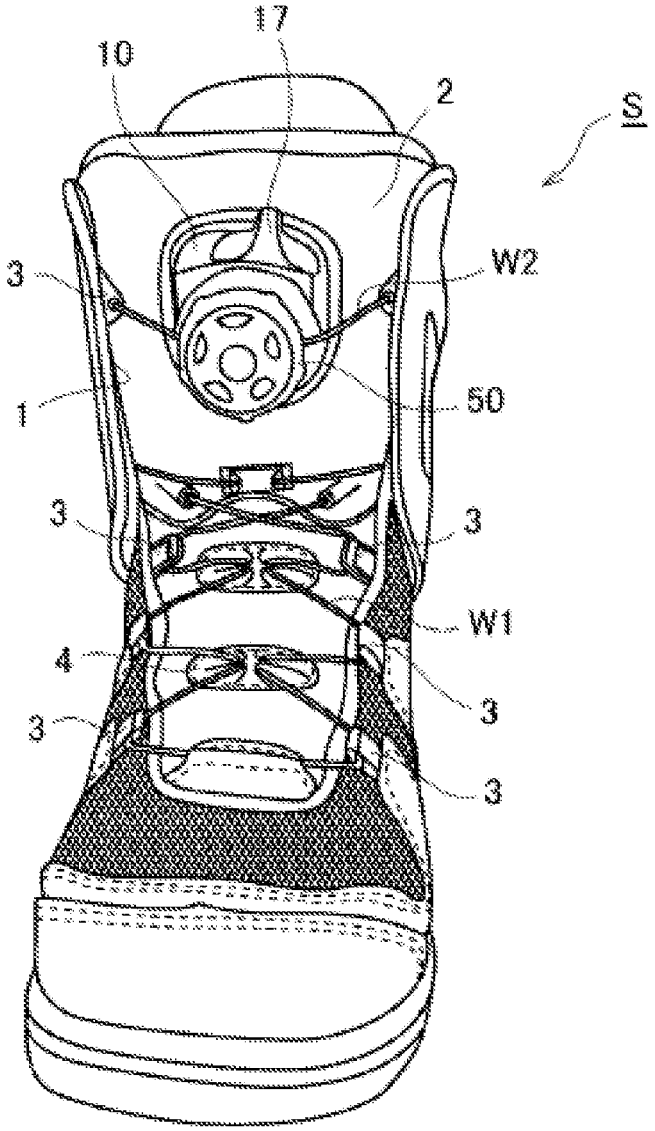
FIG. 8 is a front view showing a snowboard boot including the winding device of the present invention.

FIGS. 1 to 6 show a winding device 10 according to one embodiment of the present invention. FIG. 8 shows a snowboard boot S including the winding device 10.

In the same manner as a general snowboard boot, the snowboard boot S includes a tongue 2. The tongue 2 is arranged to close, from the inner side, an opening 1 extending from an upper surface of the instep via a front surface of an ankle portion to a shank portion. The snowboard boot S includes the winding device 10 on an upper front surface of the tongue 2.

Pairs of opposing shoestring guides 3 are fixed to an edge defining the opening 1. Further, crossing guide members 4 that guide a shoestring W1 are fixed to the tongue 2.

The crossing guide members 4 prevent the shoestrings W1 from directly rubbing against each other and breaking. The crossing guide members 4 also prevent the shoestring W1 and the tongue 2 from rubbing against each other and damaging the tongue 2.

Two wire-like shoestrings W1 and W2, each of which is a bundle of fine metal wires, are passed through the shoestring guides 3 and the crossing guide members 4 to separately tighten different portions of the snowboard boot S.

More specifically, the first shoestring W1 tightens the snowboard boot S from near the instep to the vicinity of the ankle portion, and the second shoestring W2 tightens the shank portion of the snowboard boot S.

The winding device 10 according to one embodiment of the present invention will now be described.

The winding device 10 includes a first string winding unit D1 that winds the first shoestring W1 and a second string winding unit D2 that winds the second shoestring W2.

More specifically, each of the string winding units D1 and D2 includes a tubular drum or reel with flanges extending from its two ends.

Figure 1:
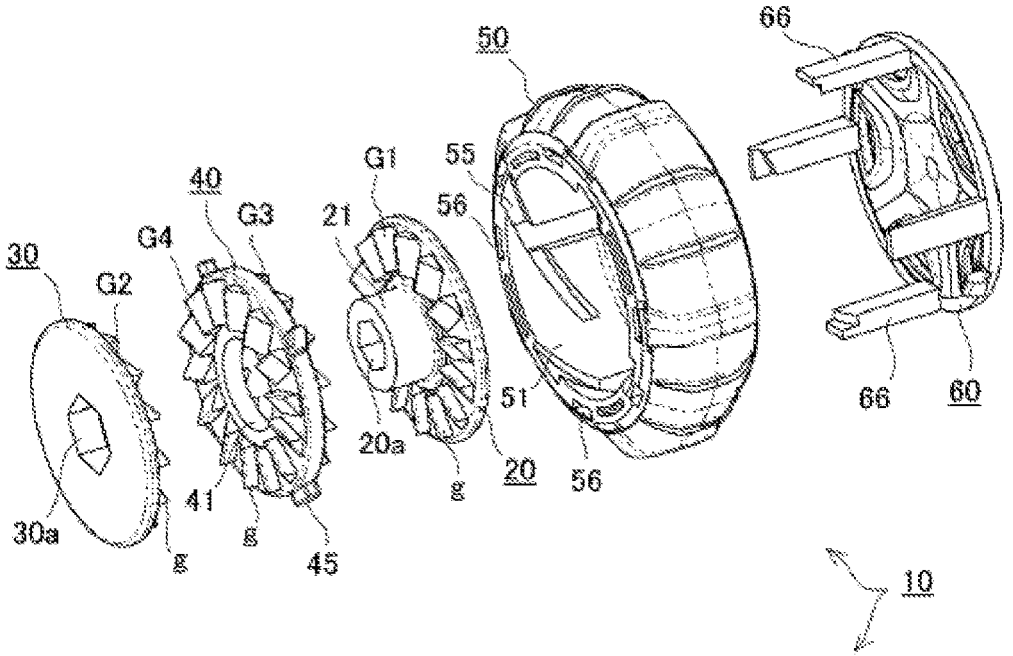
FIG. 1 is an exploded perspective view and a cross-sectional view showing components of a winding device of the present invention.
Figure 1:
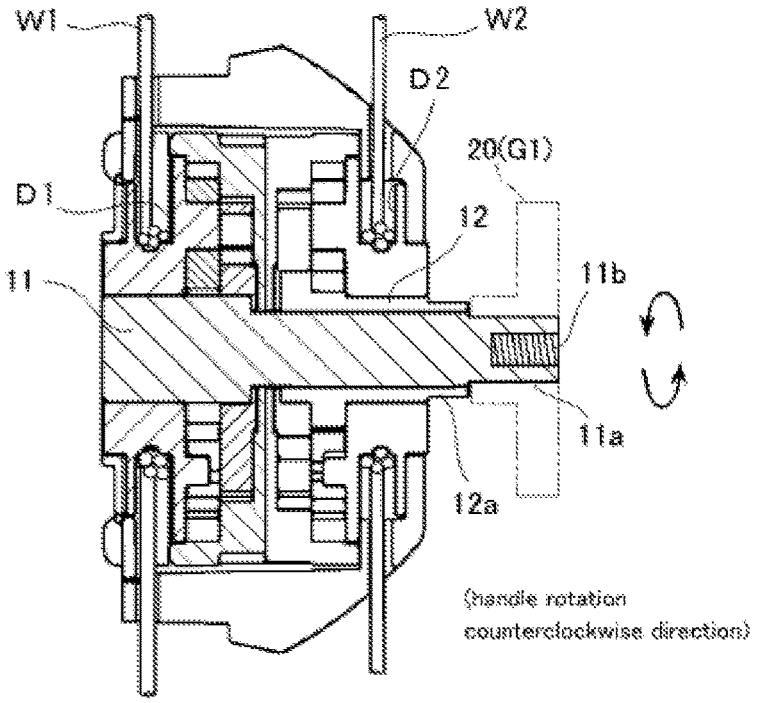
Figure 2:
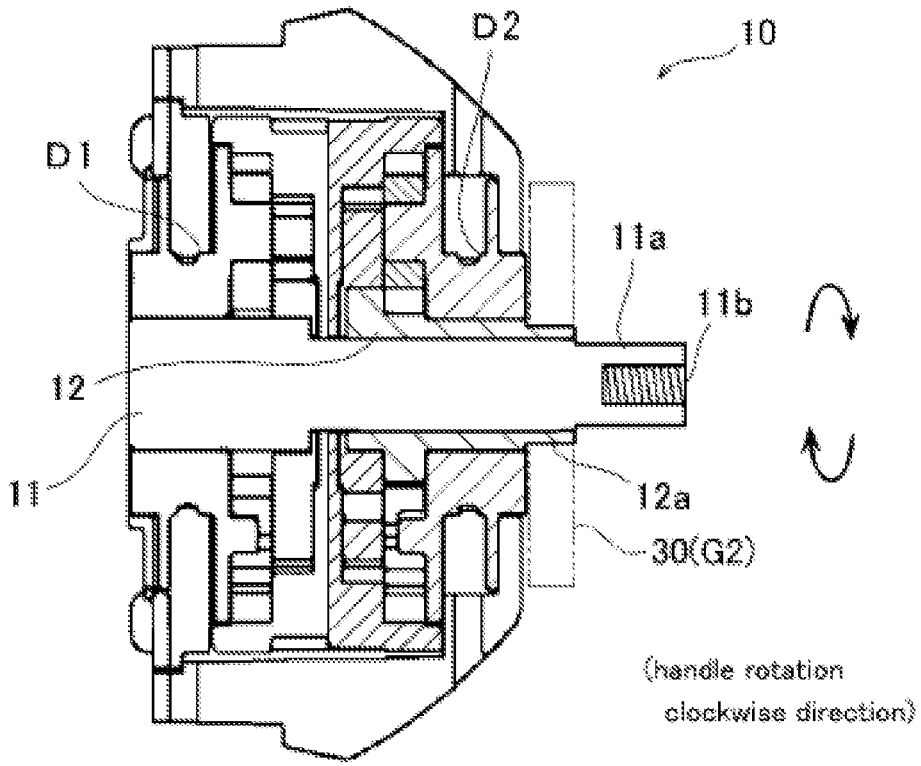
FIG. 2 is a cross-sectional view showing the winding device of the present invention.

As shown by the hatching lines in FIG. 1, the first string winding unit D1 is rotated and driven by a first rotation shaft 11 at a basal end of the first rotation shaft 11. As shown by the hatching lines in FIG. 2, the second string winding unit D2 is rotated and driven by a second rotation shaft 12 that is fitted in a rotatable manner onto the first rotation shaft 11 near a middle portion of the first rotation shaft 11.

Thus, the second rotation shaft 12 is arranged coaxially with the first rotation shaft 11 so that the first rotation shaft 11 and the second rotation shaft 12 respectively rotate and drive the first string winding unit D1 and the second string winding unit D2 independently and separately from each other.

Further, if a rotation direction of a handle 50 (described below) of the winding device 10 is switched when performing a rotation operation, the drive force of the handle 50 is automatically distributed to separately wind the first shoestring W1 and the second shoestring W2 with the first string winding unit D1 and the second string winding unit D2.

A cancellation switch 17, which is located in an upper portion of the winding device 10, disengages two ratchet pawls 18, which move in cooperation with the cancellation switch 17, from two ratchet gears 19 and simultaneously cancels the tightening of the two shoestrings W1 and W2.

Figure 6:
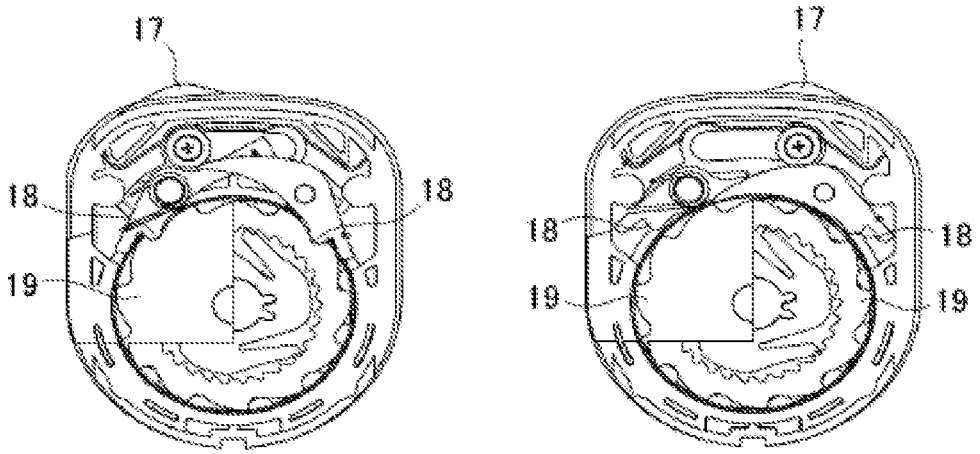
FIG. 6 is a diagram showing an internal mechanism that cancels a string tightening state with a string winding unit of the winding device of the present invention.

In the state shown in the left side of FIG. 6, the cancellation switch 17 and the ratchet pawls 18 allow the shoestrings W1 and W2 to be tightened. In the state shown in the right side of FIG. 6, the cancellation switch 17 and the ratchet pawls 18 cancel the tightening of the shoestrings W1 and W2.

The first rotation shaft 11 includes a distal end 11*a* (outer end) having an outer surface in the form of a hexagonal post. The distal end 11*a* is fitted to a hexagonal hole 20*a* that extends through a tube 21 formed at the center of a disk-shaped first gear member 20. This couples and fixes the first gear member 20 to the distal end 11*a* of the first rotation shaft 11.

The first gear member 20 includes a first gear G1. Saw-like teeth extend radially on the inner surface of the first gear member 20 along the circumference of the first gear member 20.

Further, the second rotation shaft 12 includes a distal end 12*a* (outer end) having an outer surface in the form of a hexagonal post. The distal end 12*a* is fitted to a hexagonal hole 30*a* that extends through the center of a disk-shaped second gear member 30. This couples and fixes the second gear member 30 to the distal end 12*a* of the second rotation shaft 12.

The second gear member 30 includes a second gear G2. Saw-like teeth extend radially on the outer surface of the second gear member 30 along the circumference of the second gear member 30.

The first gear G1 and the second gear G2 are spaced apart from each other. The saw teeth of the first gear G1 and the second gear G2 are directed in opposite directions when coupled to the winding device 10.

A disk-shaped sliding gear member 40 including a third gear G3 and a fourth gear G4 that respectively engage the first gear G1 and the second gear G2 is arranged between the first gear member 20 and the second gear member 30.

A circular shaft hole 41 extends through the center of the sliding gear member 40. The distal end 11*a* of the first rotation shaft 11 is inserted into the shaft hole 41 in a rotatable manner and in a slidable manner.

In the embodiment, the sliding gear member 40 is supported by the tube 21, which is formed at the center of the first gear member 20.

The third and fourth gears G3 and G4 of the sliding gear member 40 are directed in opposite directions. This allows the first rotation shaft 11 and the second rotation shaft 12 to be rotated and driven in different directions.

Thus, when the sliding gear member 40 is coupled as the winding device 10, the front and rear surfaces of the sliding gear member 40 can be reversed. This improves the coupling efficiency.

Further, the pitch of saw teeth g of the third and fourth gears G3 and G4 is set so that the saw teeth g of the third gear G3 and the saw teeth g of the fourth gear G4 are alternately formed. This allows the disk-shaped sliding gear member 40 to have a uniform thickness so that the strength does not decrease at certain portions of the sliding gear member 40.

The outer circumferential surface of the sliding gear member 40 includes four engagement projections 45 at positions spaced apart from one another by 90 degrees.

In the present embodiment, each engagement projection 45 has the form of a quadrangle post (parallelogram in cross section) having two parallel sides that contact side surfaces of inclined grooves 55 (described below) and two sides in the axial direction of the sliding gear member 40. This increases the strength and wear resistance.

The first and second gear members 20 and 30 and the sliding gear member 40 are located in a tubular gear accommodation portion 51. The gear accommodation portion 51 has a closed end and is formed in the disk-shaped handle 50.

Four inclined grooves 55 are formed in the inner surface of the gear accommodation portion 51 so that a spiral is formed along the inner circumferential surface of the gear accommodation portion 51. The engagement projections 45 engage the inclined grooves 55 so that the engagement projections 45 can slide in the inclined grooves 55.

The inclined grooves 55 are formed in the inner surface of the gear accommodation portion 51 extending from an opening in the gear accommodation portion 51 toward the closed end of the gear accommodation portion 51. Further, the winding device 10 includes lock members 66 that restrict a slidable range of the engagement projections 45, which are arranged in the inclined grooves 55 extending from the opening of the gear accommodation portion 51, in the inclined grooves 55. The lock members 66 also restrict separation of the engagement projections 45 from the inclined grooves 55.

In the present embodiment, the lock members 66 are realized as four legs that project from the back surface of a lid 60 engaged with the outer surface of the handle 50 and integrated with the handle 50. The four legs traverse and block the inclined grooves 55.

Each leg includes a distal end that engages a socket 56 formed in the rim of the handle 50 extending around the opening so that the leg (lock member 66) is stably coupled to the inner circumferential surface of the handle 50.

If the lock members 66 are separate from the handle 50 like in the present embodiment, when molding the handle 50, the handle 50 can be easily removed from a mold by rotating the handle 50.

Figure 4:
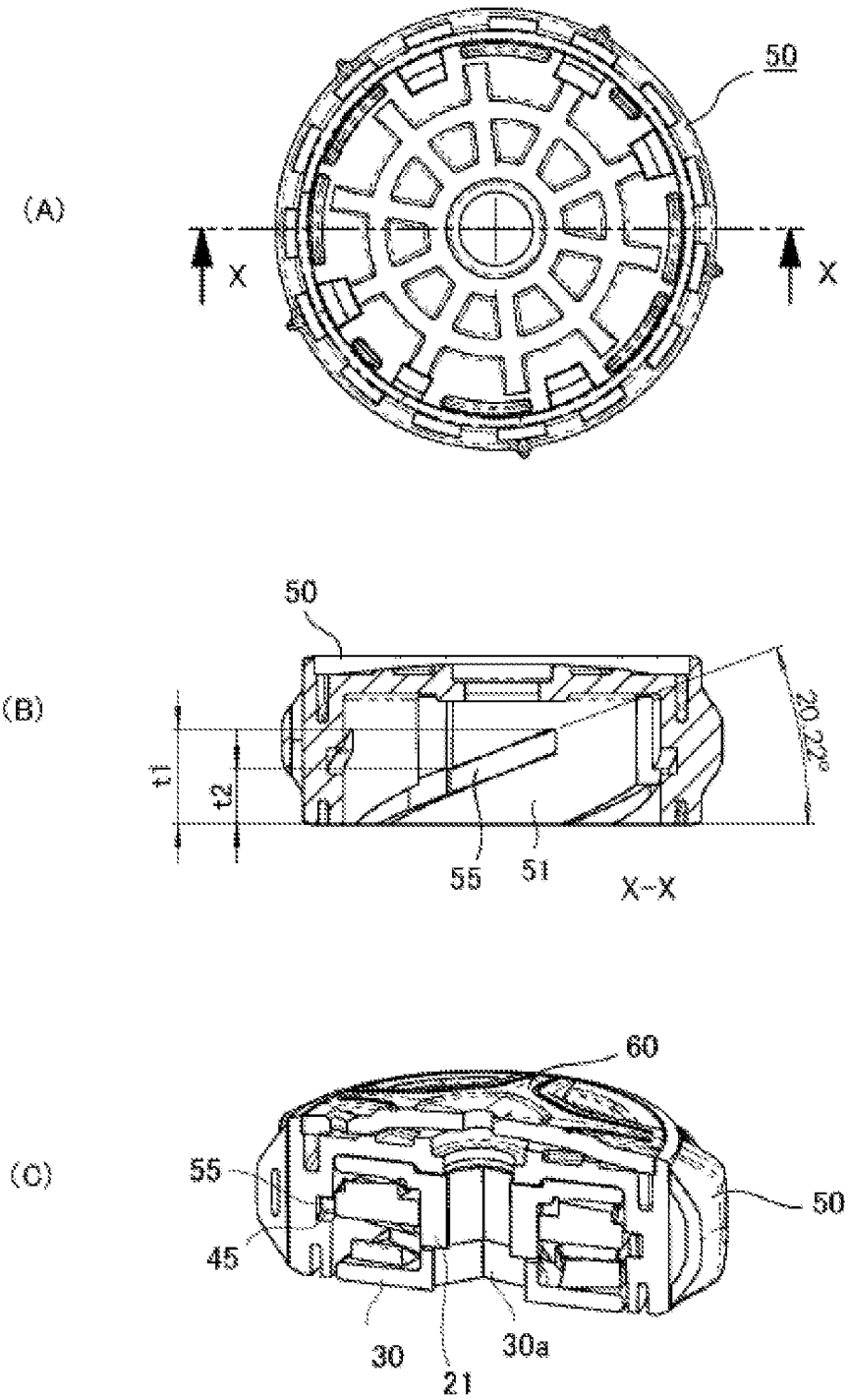
FIG. 4 is a plan view showing a handle of the winding device of the present invention and a cross-sectional view showing the inner side of the handle.

With the above structure, as shown in FIG. 4, within the height (length) t1 in which the inclined groove 55 is formed in the axial direction of the rotation shafts 11 and 12, the height (distance) over which the engagement projection 45 can move in the inclined groove 55, that is, the distance over which the sliding gear member 40 can slide, is a range obtained by subtracting the height t2, which is from the opening of the handle 50 to the position of the lock member 66, from the height t1 (t1−t2).

Further, the height of the saw teeth g is equal in each of the gears G1 to G4. Thus, the sliding gear member 40 comes into close contact with the first gear member 20 or the second gear member 30 over the maximum area when the sliding gear member 40 slides and moves to either one of the two limit positions (refer to FIG. 5).

In the above structure in which the gears G1 to G4 are arranged as described above, a simple and easy operation of changing the rotation direction of the handle 50 automatically moves the sliding gear member 40 in the axial direction of the first and second rotation shafts 11 and 12 and selectively switches the gear engaged with the gear of the sliding gear member 40 between the first gear G1 and the second gear G2. This rotates and drives the selected gear.

Accordingly, when tightening the first shoestring W1 and the second shoestring W2, the handle 50 is held and rotated in different directions, namely, the forward direction and the reverse direction. This allows the first shoestring W1 and the second shoestring W2 to be continuously and quickly tightened without the need to release the handle 50 or change the position of the handle 50 by pulling or pushing the handle 50.

Figure 5:
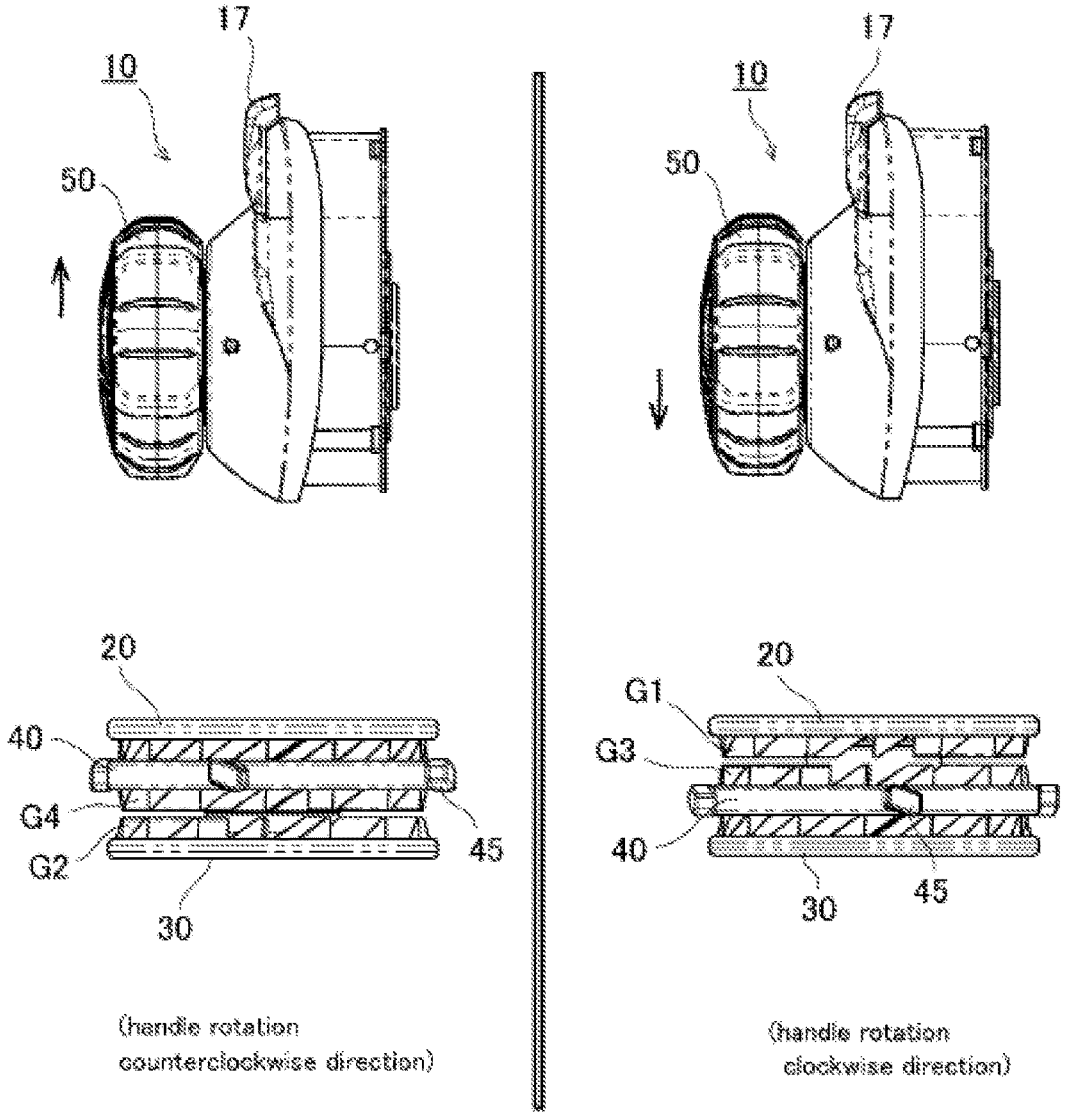
FIG. 5 is a side view showing the outer appearance of the winding device of the present invention and the engagement of gears.

In the state of the handle 50 and the gears G1 to G4 shown in the left side of FIG. 5, leftward rotation of the handle 50 causes engagement of the gear G1 and gear G3 that rotates and drives the first rotation shaft 11 and the first string winding unit D1. In the state of the handle 50 and the gears G1 to G4 shown in the right side of FIG. 5, rightward rotation of the handle 50 causes engagement of the gear G2 and gear G4 that rotates and drives the second rotation shaft 12 and the second string winding unit D2.

A bolt hole lib extends through the distal end 11*a* of the first rotation shaft 11. A bolt 11*c* is fixed to the bolt hole 11*b* so that the first gear member 20 and the like are not separated from the first rotation shaft 11 and the second rotation shaft 12.

Figure 3:
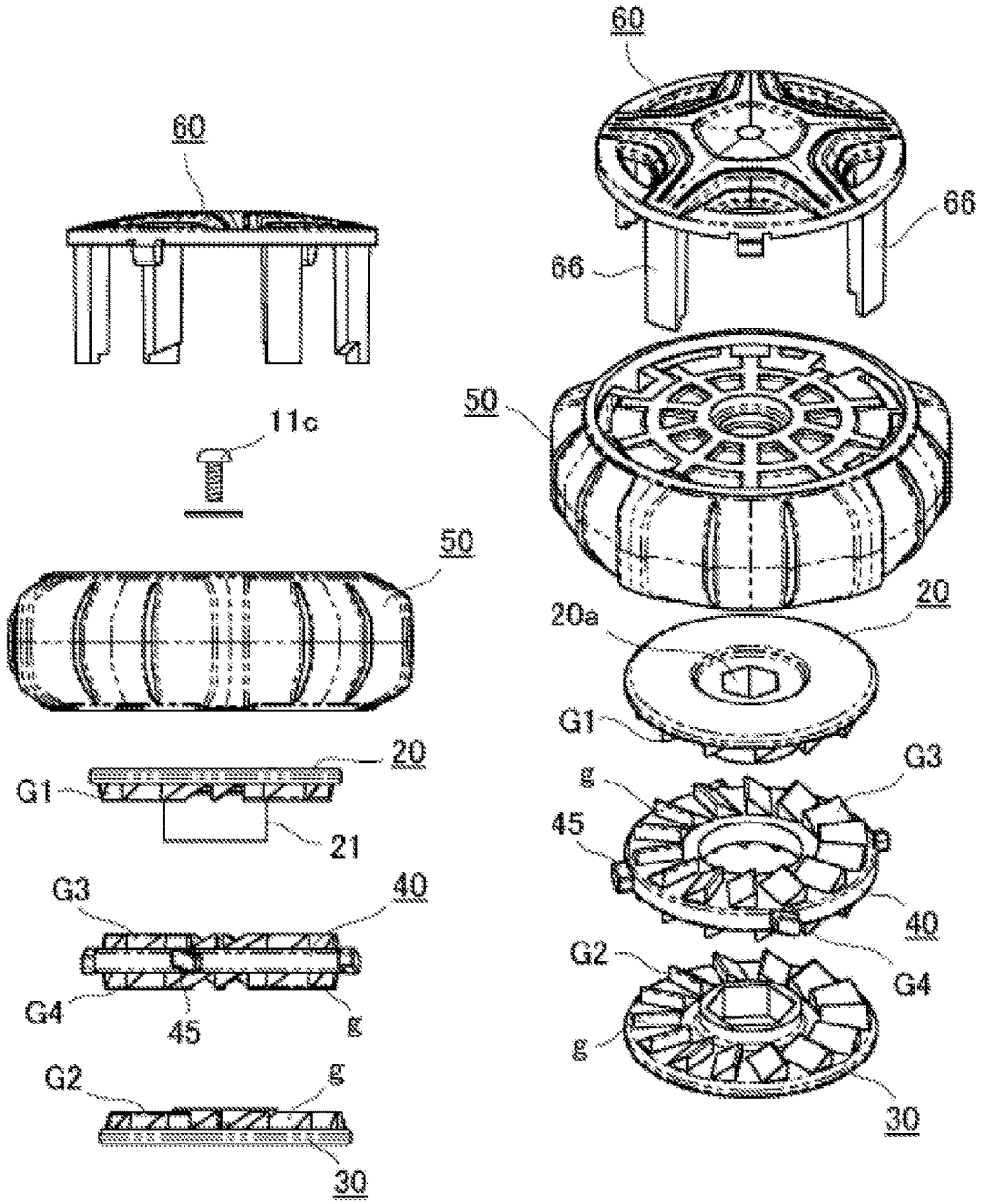
FIG. 3 is a side view and a perspective view showing the components of the winding device of the present invention.

The winding device 10 and the snowboard boot S of the present invention can be easily manufactured using a casting technique, a resin molding technique, a sewing technique, or the like known in the art. The winding device 10 can be easily manufactured by arranging and sequentially coupling the components as shown in FIG. 3 and the like.

The saw teeth g of each of the gears G1 to G4 each have the form of a horizontally extending triangular post having the cross section of a right triangle. One side surface of each saw tooth g that is engaged with another gear is orthogonal to a gear formation surface. Further, the saw teeth g extend radially and are arranged in equal intervals about the axes of the first and second gear members 20 and 30 and the sliding gear member 40.

Further, in the present embodiment, the gears G1 to G4 are manufactured from nylon resins containing glass fiber, the first and second string winding units D1 and D2 are manufactured by die casting zinc, and the ratchet pawls 18 are manufactured from stainless steel.

The snowboard boot S including the winding device 10 allows the winding amount of the shoestrings W1 and W2 to be separately adjusted and the tightening degree of the shoestrings W1 and W2 to be independently changed. Additionally, the snowboard boot S allows the two shoestrings W1 and W2, which tighten different portions of the boot S, to be quickly wound and tightened without the need to release the handle 50 of the winding device 10.

Figure 7:
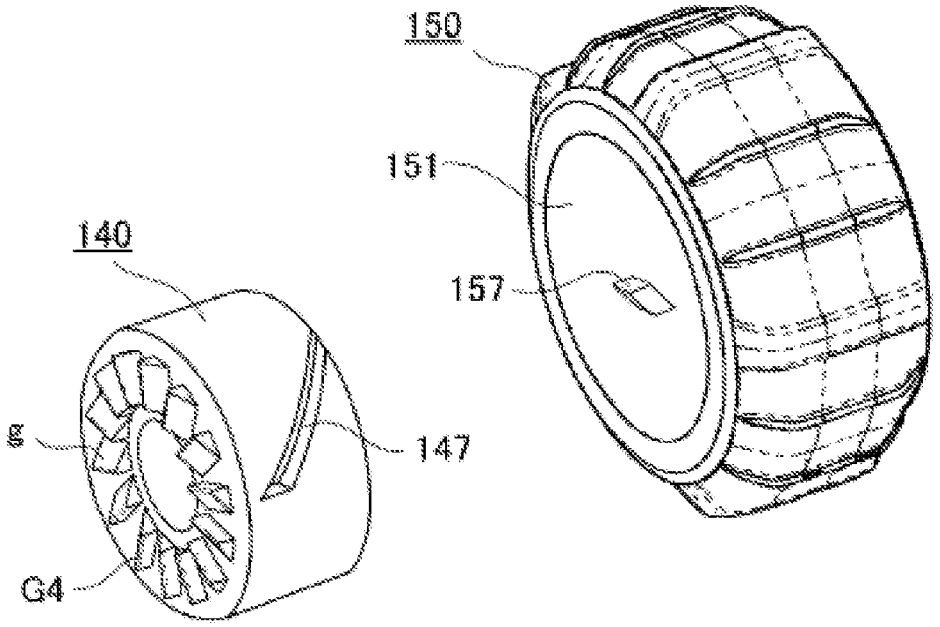
FIG. 7 is an exploded perspective view showing another embodiment of the winding device of the present invention.

FIG. 7 shows a tubular sliding gear member 140 and a handle 150 that can be applied to a winding device according to another embodiment of the present invention. An inclined groove 147 is formed in an outer surface of the sliding gear member 140. The third and fourth gears G3 and G4 are formed on two ends of the sliding gear member 140. A plurality of engagement projections 157 are formed in an inner surface of a tubular gear accommodation portion 151 that has a closed end and is formed in the handle 150. This allows the sliding gear member 140 to slide in the axial direction of the first and second rotation shafts 11 and 12.

In this case, the rotation direction of the handle 150 also automatically switches the gear engaged with the gears G3 and G4 of the sliding gear member 140 between the first gear G1 and the second gear G2, and a simple and easy operation of changing the rotation direction of the handle 150 selectively rotates and drives the first rotation shaft 11 or the second rotation shaft 12.

However, in this embodiment, the sliding gear member 140 and the handle 150 are lengthened in the axial direction.

In the specification, as long as the handles 50 and 150 accommodate the sliding gear members 40 and 140 and function as operation portions that rotate and drive the gears G1 to G4, the outer shapes of the handles 50 and 150 are not particularly limited. The handles 50 and 150 may be disk-shaped, oval, or polygonal dials. Alternatively, the handles 50 and 150 may be plate-shaped, trifurcated, cross-shaped, or star-shaped knobs or levers.

Further, as long as the engagement projections 45 and 157 have sufficient strength and durability, the engagement projections 45 and 157 may have the form of a post that is a cylinder, or an oval cylinder in cross section, or the form of a quadrangle post having a cross section other than that of a parallelogram.

In addition, the number of the engagement projections 45 and 157 and the number of the inclined grooves 55 and 147 may be changed, for example, within a range of two to six that is included in the range of the present invention.

Additionally, the inclination angles of the inclined grooves 55 and 147 may be changed in accordance with the sliding movement of the sliding gear members 40 and 140 that are necessary for switching the engagement of the gears G1 to G4.

The present invention is not limited to a winding device that tightens shoestrings that are arranged like in the above embodiments. Instead, the present invention may be applied to a winding device that winds a dual-adjustment shoestring that tightens different parts of the instep of the shoe and a winding device that winds a dual-adjustment shoestring that tightens different parts of the upper portion of the shoe. In addition, the present invention may be applied to tighten shoestrings that tighten an inner boot of a shoe.

When the present invention is realized, play of the handles 50 and 150 can be reduced by setting the distance between (pitch of) the saw teeth g of each gear (at least one of G1 to G4 or G1 and G2) to achieve close contact or increasing the inclination angles of the inclined grooves 55 and 147 toward the axial direction (for example, inclination angle of approximately 20 degrees in the embodiments is set to approximately 60 degrees).

Further, in the above embodiments, the first and second shoestrings W1 and W2 may have a low friction coefficient such as woven metal wire ropes in a preferred manner. Synthetic resin coated wires (coating ropes) may also be used as the first and second shoestrings W1 and W2.

The present invention is not limited to the above embodiments. The winding device of the present invention may be applied to tighten not only strings of boots used for skiing, skating, mountain climbing, or motorcycle riding but also to strings of bags.

In addition, the present invention may be realized by changing the material, shape, dimension, strength, position, thickness, size, number, and the like without departing from the spirit of the present invention.

INDUSTRIAL APPLICABILITY

The present invention can be used in a preferred manner as a winding device that tightens shoestrings of boots used for skiing, snowboarding, skating, mountain climbing, or motorcycle riding or for tightening strings of bags.

DESCRIPTION OF REFERENCE CHARACTERS

S: snowboard boot
1: opening
2: tongue
3: shoestring guide
4: crossing guide member
10: winding device
11: first rotation shaft
11*a*: distal end
11*b*: bolt hole
11*c*: bolt
12: second rotation shaft
12*a*: distal end
17: cancellation switch
18: ratchet pawl
19: ratchet gear
20: first gear member
20*a*: hexagonal hole
21: tube
30: second gear member
30*a*: hexagonal hole
40: sliding gear member
41: shaft hole
45: engagement projection
50: handle
51: gear accommodation portion
55: inclined groove
56: socket
60: lid
66: lock member
140: sliding gear member
147: inclined groove
150: handle
151: gear accommodation portion
157: engagement projection
D1: first string winding unit
D2: second string winding unit
G1: first gear
G2: second gear
G3: third gear
G4: fourth gear
g: saw teeth
t1: height
t2: height
W1: first shoestring
W2: second shoestring

The invention claimed is:

1. A winding device comprising:

a first rotation shaft that rotates and drives a first string winding unit;

a second rotation shaft arranged coaxially with the first rotation shaft to rotate and drive a second string winding unit;

a first gear coupled to the first rotation shaft;

a second gear coupled to the second rotation shaft and located at a position opposing the first gear and spaced apart from the first gear;

a sliding gear member arranged between the first and second gears and including a third gear and a fourth gear respectively engaged with the first gear and the second gear;

a handle including a gear accommodation portion that is tubular and has a closed end, and accommodates the first gear, the second gear, and the sliding gear member;

an inclined groove formed in an inner surface of the gear accommodation portion and extending in the inner surface of the gear accommodation portion from an opening of the gear accommodation portion toward the closed end of the gear accommodation portion;

an engagement projection formed on an outer surface of the sliding gear member, wherein the engagement projection engages the inclined groove and is slidable in the inclined groove; and a lock member that restricts a slidable range of the engagement projection, which is arranged in the inclined groove, from the opening of the gear accommodation portion and restricts separation of the engagement projection from the inclined groove, wherein a change in a rotation direction of the handle moves the sliding gear member in an axial direction of the first and second rotation shafts and switches the gear engaged with and rotated and driven by the gear of the sliding gear member between the first gear and the second gear.

2. The winding device according to claim 1, wherein the engagement projection is one of a plurality of engagement projections formed in equal intervals.

3. The winding device according to claim 1, wherein the engagement projection is formed as a quadrangle post including two parallel sides that contact side surfaces of the inclined groove.

* * * * *